US006972360B1

(12) United States Patent
Ekin

(10) Patent No.: US 6,972,360 B1
(45) Date of Patent: Dec. 6, 2005

(54) STRINGED MUSICAL INSTRUMENT

(76) Inventor: Gary Ekin, 140 Ladera Dr., Santa Cruz, CA (US) 95060

( * ) Notice: Subject to any disclaimer, the term of this patent is extended or adjusted under 35 U.S.C. 154(b) by 80 days.

(21) Appl. No.: 10/663,184

(22) Filed: Sep. 16, 2003

(51) Int. Cl.[7] ..... G10D 3/14
(52) U.S. Cl. ..... 84/312 R; 84/312 P; 84/313; 84/297 R; 84/298; 84/299; 84/304
(58) Field of Search ..... 84/312 R, 312 P, 84/313, 297 R, 298, 299, 304, 267

(56) References Cited

U.S. PATENT DOCUMENTS

| | | | | |
|---|---|---|---|---|
| 1,431,250 A | | 10/1922 | Oettinger | |
| 2,397,289 A | * | 3/1946 | Proll | 84/297 R |
| 4,007,658 A | | 2/1977 | Spain | |
| 4,080,864 A | | 3/1978 | Jackson | |
| 4,080,865 A | | 3/1978 | Gfell | |
| 4,106,387 A | | 8/1978 | Alifano | |
| 4,157,050 A | | 6/1979 | Lashley | |
| 4,175,467 A | | 11/1979 | Lashley | |
| 4,342,249 A | | 8/1982 | McCormick et al. | |
| 4,674,387 A | * | 6/1987 | Caruth | 84/304 |
| 4,704,935 A | | 11/1987 | Franklin | |
| 4,724,737 A | | 2/1988 | Fender | |
| 4,794,838 A | | 1/1989 | Corrigan, III | |
| 4,872,388 A | * | 10/1989 | Gunn | 84/297 R |
| 5,044,247 A | | 9/1991 | Stepp | |
| 5,092,214 A | | 3/1992 | Flynn | |
| 5,277,094 A | * | 1/1994 | Spuler | 84/298 |
| 5,760,321 A | | 6/1998 | Seabert | |
| 5,814,746 A | | 9/1998 | Stafford | |

* cited by examiner

*Primary Examiner*—Shih-Yung Hsieh
(74) *Attorney, Agent, or Firm*—Jack Lo

(57) ABSTRACT

A stringed musical instrument includes a surfboard shaped body with strings on top. The strings have first ends attached to tuners under the body adjacent a first end, and second ends attached to a fixed anchor on top of the body adjacent a second end. A pitch changer comprised of an eccentric cam on an axle is positioned on a played string. A lever connected to the axle is provided for rotating the cam to adjust the tension on the string. A second embodiment is comprised of a body with tuners and a pitch changer adjacent the same end of the body. A third embodiment includes a combined tuner and pitch changer comprised of hinged arms with first ends pivoted on an axle. The strings are attached to intermediate positions on the arms. Screws are positioned against second ends of the arms for adjusting the tension on the strings.

10 Claims, 5 Drawing Sheets

STRINGED MUSICAL INSTRUMENT

BACKGROUND OF THE INVENTION

1. Field of the Invention

The invention broadly relates to stringed musical instruments with tuners and pitch changers.

2. Prior Art

A Hawaiian steel guitar or lap steel stringed musical instrument is comprised of an elongated body which is free standing on legs, or which sits on a player's lap. Strings are strung longitudinally over a fingerboard surface on top of the body. The strings are attached to tuners that tighten or loosen the strings. Tuning is inaccurate because the strings are angled relative to the tuners. The tuning also tends to change due to string slack around the tuners. Once tuned, the player's playing style is limited by the fixed tuning. Further, the rectangular shape and square edges of the instrument body is uncomfortable to hold on a player's lap.

BRIEF SUMMARY OF THE INVENTION

Objects of the present stringed musical instrument are:

to be more comfortable on a player's lap;

to enable faster tuning;

to enable accurate tuning;

to position the tuners within easy reach;

to enable pitch change during play;

to attach the strings to tuners along unobstructed paths;

to enable tuning and pitch change in a single adjustment device; and to generally hide the tuners and pitch changer for an uncluttered appearance.

A stringed musical instrument is comprised of a surfboard shaped body with rounded edges. Strings are positioned between bridges on top of the body. The strings include first ends which are threaded through the body and attached to tuners under the body adjacent a first end thereof. The tuners comprise a single series of knobs outside the body, and respective rods positioned inside a recess in the body and connected to the first ends of the strings. The strings include second ends which are attached to a fixed anchor inside a recess on top of the body adjacent a second end thereof. A pitch changer is positioned on one of the strings adjacent the anchor. The pitch changer is comprised of an eccentric cam on an axle. A lever connected to the axle is provided for rotating the cam and adjusting the tension on the string to change its pitch. A second embodiment of the instrument is comprised of a body with tuners and a pitch changer adjacent the same end of the body. The tuners are arranged in two series along opposite edges of the body. The tuners on each side of the body include rods with inner ends connected to second ends of the strings. The rods are of graduated lengths to position their inner ends in a stepped arrangement to avoid interfering with adjacent strings. In a third embodiment, the instrument includes a combined tuner and pitch changer comprised of hinged arms with first ends pivoted on an axle. The second ends of the strings are attached to intermediate positions on the arms. The inner ends of screws extending through the body of the instrument are positioned against respective second ends of the arms for adjusting the tension on the strings.

DRAWING REFERENCE NUMERALS

| | |
|---|---|
| 10. Body | 11. String |
| 12. Bridge | 13. Tuner |
| 14. Knob | 15. Gear Box |
| 16. Wall | 17. Recess |
| 18. Rod | 19. Adapter Tube |
| 20. Wall | 21. First End |
| 22. Hole | 23. Support Rod |
| 24. Pitch Changer | 25. Recess |
| 26. Cam | 27. Axle |
| 28. Bearing | 29. Lever |
| 30. Second End | 31. Anchor |
| 32. Setscrew | 33. Stop |
| 34. Obstacle | 35. Peg |
| 36. Ring | 37. Setscrew |
| 38. Tuner | 39. Pitch Changer |
| 40. Body | 41. String |
| 42. Bridge | 43. Rod |
| 44. Rod | 45. Rod |
| 46. Rod | 47. Gear Box |
| 48. Tuner and Pitch Changer | 49. Arm |
| 50. First End | 51. Axle |
| 52. String | 53. Body |
| 54. Second End | 55. Slot |
| 56. Screw | |

DETAILED DESCRIPTION OF THE INVENTION

Figure 1:
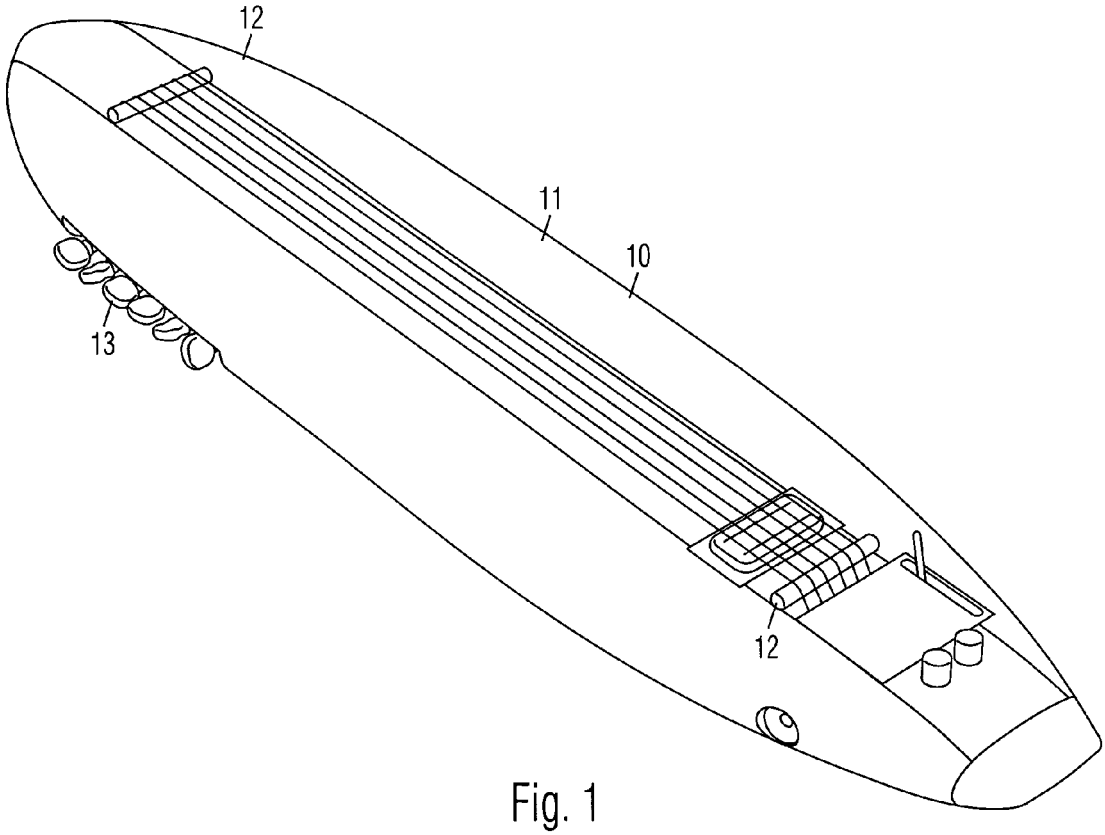
FIG. 1 is a perspective view of the present stringed musical instrument.

FIG. 1:

A stringed musical instrument shown in FIG. 1 is comprised of a surfboard shaped body 10 with rounded edges for comfort. Strings 11 are positioned between bridges 12 on top of body 10. Strings 11 include first ends which are threaded through body 10 and attached to tuners 13 on a bottom of body 10 adjacent a first end thereof. Strings 11 include second ends which are attached to a top of body 10 adjacent a second end thereof. The instrument may be electronic or acoustic.

Figure 2:
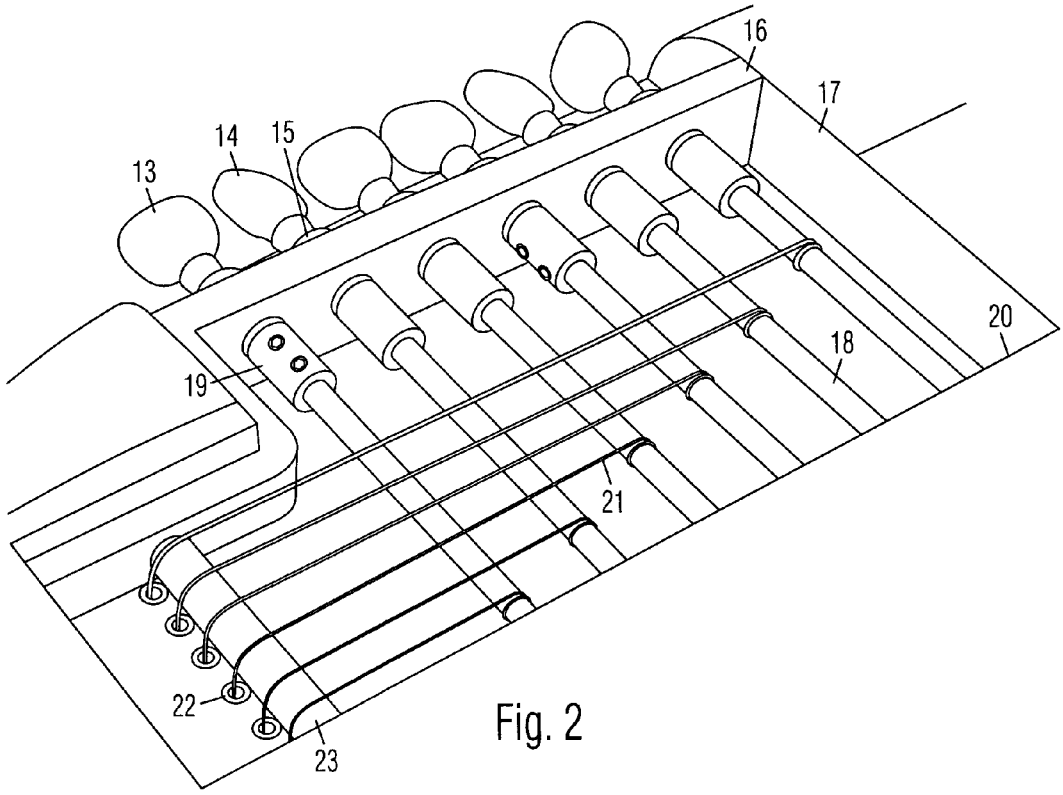
FIG. 2 is bottom perspective view thereof showing a series of tuners.

FIG. 2:

A bottom perspective view of the instrument is shown in FIG. 2. A series of tuners 13 are positioned on a bottom of body 10. Tuners 13 are comprised of a single series of knobs 14 on the bottom of body 10 connected to respective gear boxes 15, which are positioned through a wall 16 of a recess 17 on the bottom of body 10. Extension rods 18 are connected to rotatable inner ends of gear boxes 15 by adapter tubes 19. Alternatively, extension rods 18 may be integral to the inner ends of gear boxes 15. Extension rods 18 are positioned inside recess 17. Rods 18 are normally hidden under a removable cover (not shown) on recess 17. The ends of extension rods 18 opposite adapters 19 are supported by an opposite wall 20 of recess 17. First ends 21 of strings 11 are positioned through holes 22 in body 10, around a rotatable support rod 23 inside recess 17, and wrapped around respective extension rods 18. First ends 21 of strings 11 are coplanar, and are orthogonal to extension rods 18. Having strings 11 orthogonal to the rotational axes of tuners 13 ensure more accurate tuning. Strings 11 are tuned by turning knobs 14 to rotate rods 18 and adjust the tension on strings 11.

Figure 3:
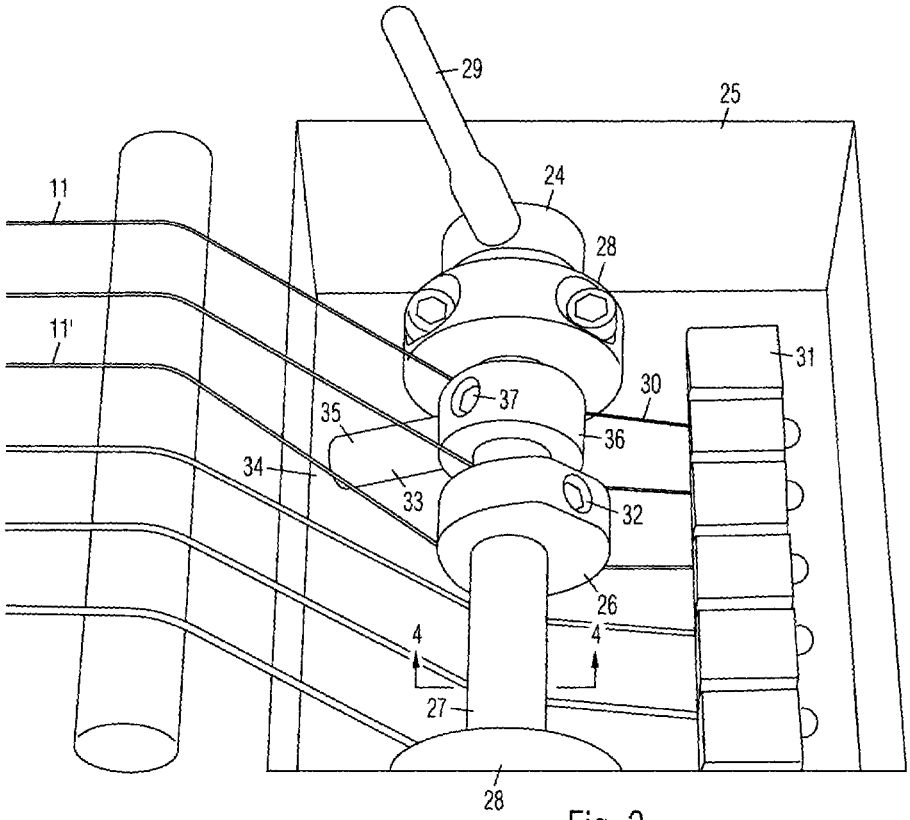
FIG. 3 is a top perspective of thereof showing a pitch changer.

FIGS. 3–5:

A top perspective of the instrument is shown in FIG. 3. A pitch changer 24 is positioned inside a recess 25 on top of body 10. Pitch changer 24 is comprised of an eccentric cam 26 pressed against a played string 11', and attached to an axle 27 positioned inside recess 25. Pitch changer 24 is normally hidden under a removable cover (not shown). Axle 27 is supported in bearings 28 secured inside recess 25. A lever 29 connected to axle projects 27 outside recess 25 for easy reach during play. Second ends 30 of strings 11 are secured to a fixed anchor 31 inside recess 25. The tension of played string 11' is adjusted by rotating eccentric cam 26 to engage played string 11' with differently thick portions thereof. Cam 26 is adjusted by initially rotating it until the pitch of played string 11' is raised to a desired first pitch. Cam 26 is locked on axle 27 with a setscrew 32 to set a first position. Axle 27 is rotated to adjust the tension on played string 11' until a desired second pitch is reached. When the second pitch is reached, a stop 33 is adjusted to engage an obstacle 34, such as the bottom of recess 25, and locked with a setscrew. Stop 33 is comprised of a peg 35 attached to a ring 36 which is rotatable around axle 27 when a setscrew 37 on ring 36 is loosened.

Figure 4:
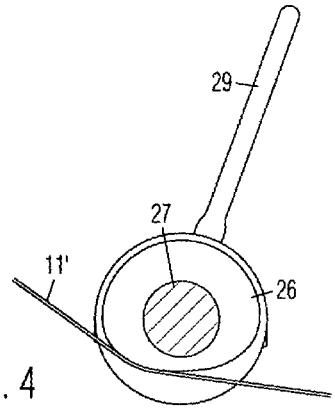
FIG. 4 is a sectional view of the pitch changer taken along line 4—4 in FIG. 3 in a first position.
Figure 5:
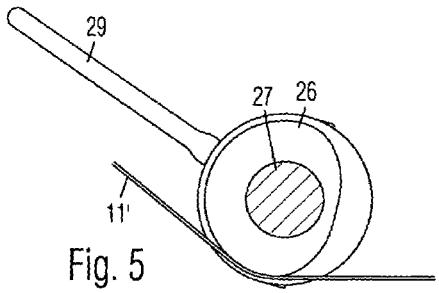
FIG. 5 is a sectional view of the pitch changer in a second position.

As shown in the sectional views in FIGS. 4–5, pitch changer 24 enables a player to change, for example, from a major to a minor tuning during play simply by moving lever 29 and rotating cam 26 against played string 11'. Additional cams may be provided for engaging other strings.

Figure 6:
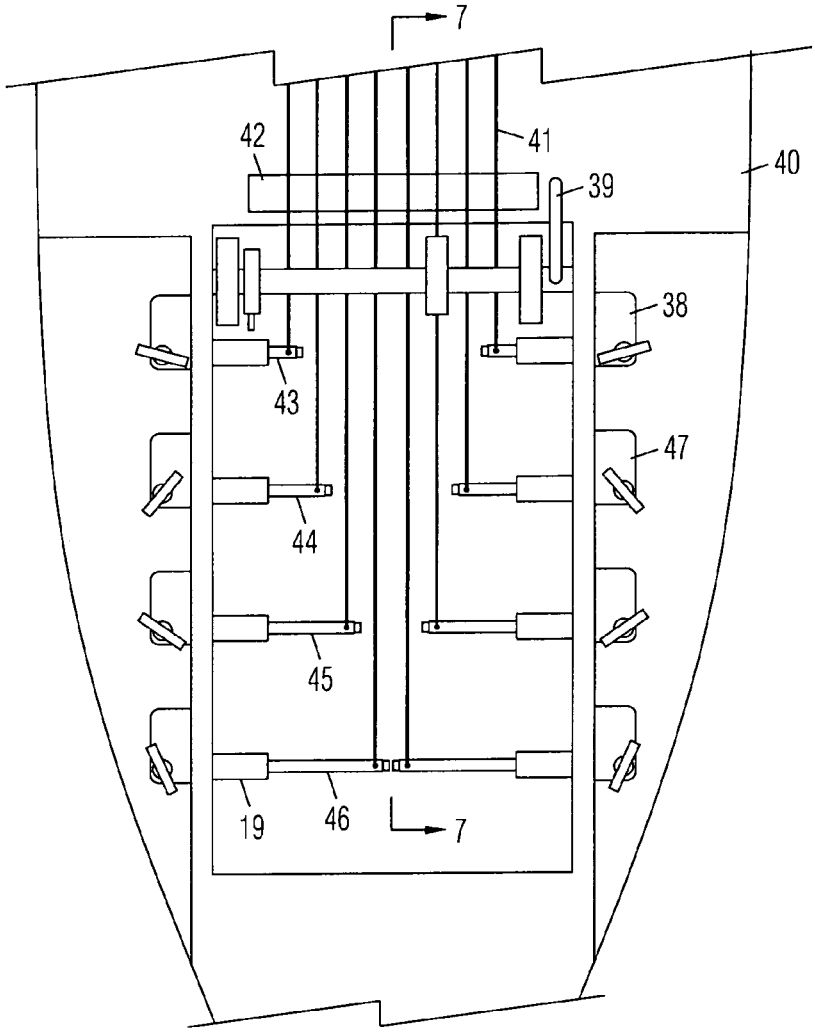
FIG. 6 is a bottom view of a second embodiment thereof showing tuners and a pitch change at the same end thereof.
Figure 7:
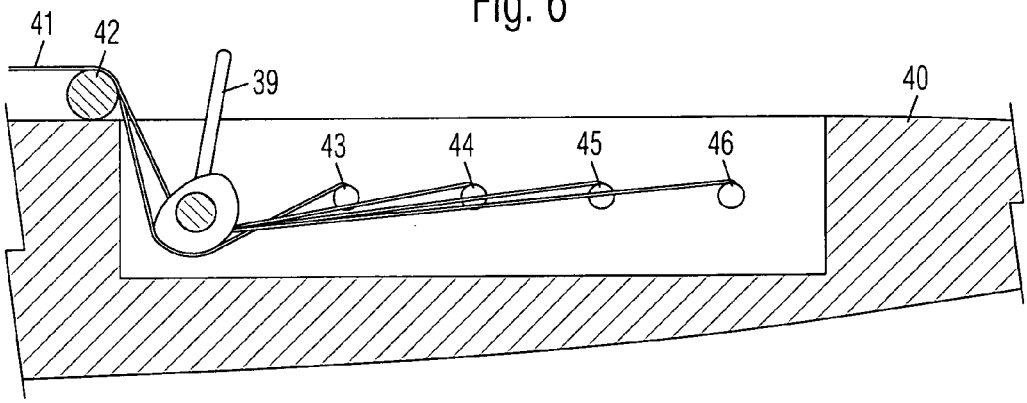
FIG. 7 is a sectional view of the instrument of FIG. 6 taken along line 6—6 in FIG. 6.

FIG. 6:

A top view of a second embodiment of the musical instrument is shown in FIG. 6, and a side sectional view thereof is shown in FIG. 7. In this embodiment, tuners 38 and a pitch changer 39 are positioned adjacent each other instead of at opposite ends of a surfboard shaped body 40. Strings 41 are positioned across bridges 42 (one shown) on top of body 40, under pitch changer 39, and wrapped around respective ends of extension rods 43–46 attached to inner ends of tuners 38. Tuners 38 are arranged in two parallel series on opposite sides of body 40. Extension rods 43–46 are attached to rotatable inner ends of gear boxes 47 of tuners 38 by adapter tubes 19.

Extension rods 43–46 on each side of body 40 are of graduated lengths to position their inner ends in a stepped arrangement, wherein the rods attached to shorter strings are shorter, and the rods attached to longer strings are longer. The stepped arrangement of extension rods 43–46 allow the rods to be orthogonal to strings 41 without having the rods interfering with adjacent strings. The orthogonal positions between strings 41 and rods 43–46 ensure more accurate tuning.

Figure 8:
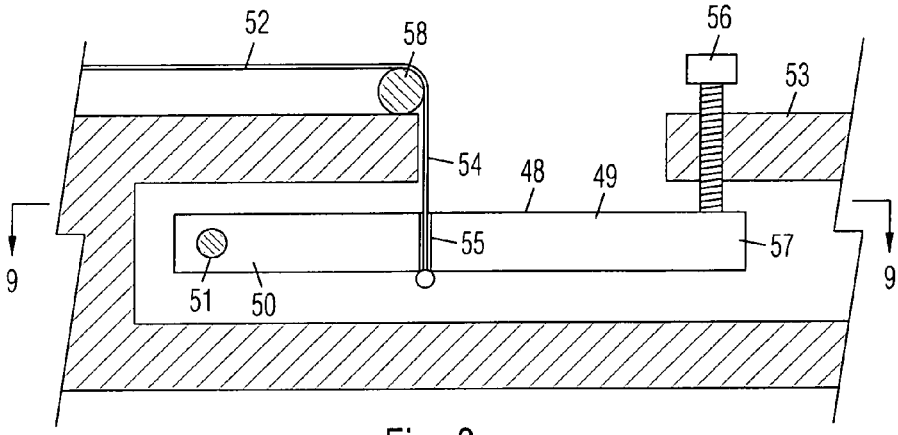
FIG. 8 is a side sectional view of a third embodiment of the instrument showing a combined tuner and pitch changer in a first position.
Figure 9:
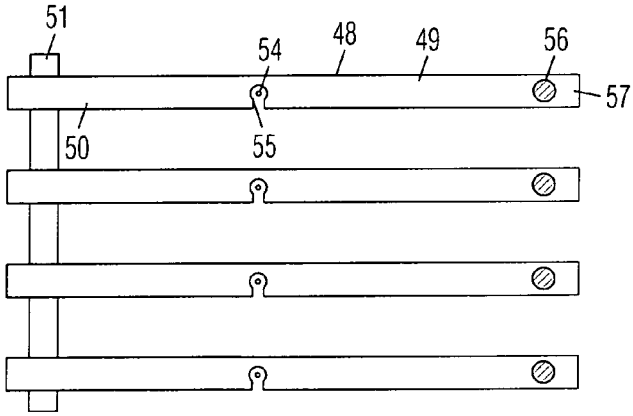
FIG. 9 is a top view of combined tuner and pitch changer of FIG. 8 taken along line 9—9 in FIG. 8.

FIGS. 8–10:

A third embodiment of the musical instrument is shown in a sectional view in FIG. 8. A combined tuner and pitch changer 48 is comprised of hinged arms 49 with first ends 50 pivoted on an axle 51. A top view of combined tuner and pitch changer is shown in FIG. 9. The first ends (not shown) of strings 52 are attached to a fixed anchor (not shown) adjacent an opposite end of a surfboard shaped body 53. Strings 52 are curved around a bridge 58 on top of body 53. Second ends 54 of strings 52 are attached to intermediate positions on arms 49 below a surface of body 53. Open slots 55 on the sides of arms 49 allow strings 52 to slide in easily. Inner ends of adjustment screws 56 extending through body 53 are positioned against respective second ends 57 of arms 49. Alternatively, axle 51 and strings 52 maybe attached to other positions on arms 49.

Tension on strings 52 is increased when screws 56 are rotated to pivot arms 49 downward a small distance. Strings 52 are tuned by rotating screws 56 to adjust the tension. Pitch change can be individually made to strings 52 by turning screws 56 between predetermined positions. There is no slack in the connection between strings 52 and arms 49, and the pull across the small distances traveled by arms 49 are generally linear, so that the pitch adjustment is very accurate.

Figure 10:
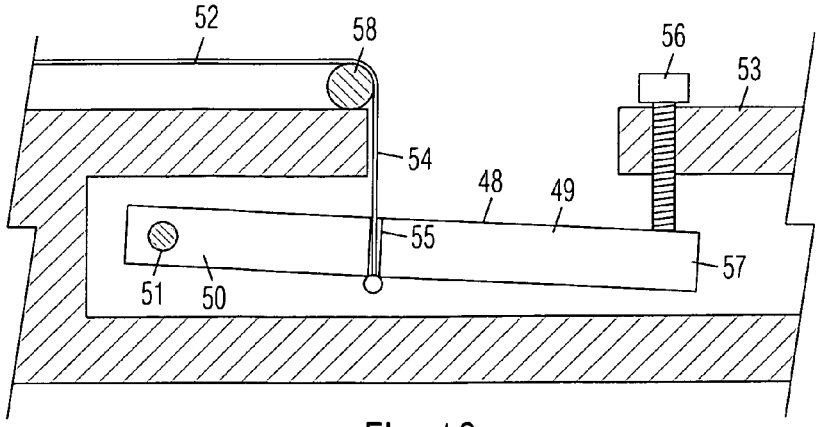
FIG. 10 is a side sectional view of the combined tuner and pitch changer of FIG. 8 in a second position.

Although the foregoing description is specific, it should not be considered as a limitation on the scope of the invention, but only as an example of the preferred embodiment. Many variations are possible within the teachings of the invention. For example, different attachment methods, fasteners, materials, dimensions, etc. can be used unless specifically indicated otherwise. The relative positions of the elements can vary, and the shapes of the elements can vary. The tuners shown in FIG. 6 can be replaced with the tuners shown in FIG. 2. The eccentric cam pitch changer shown in FIG. 3 can be provided in the same instrument with the combined tuner and pitch changer shown in FIGS. 8–10. Therefore, the scope of the invention should be determined by the appended claims and their legal equivalents, not by the examples given.

I claim:

1. A stringed musical instrument, comprising:

a body;

strings tensioned on top of said body; and a pitch changer pressed against a played string, wherein said pitch changer is comprised of an eccentric cam arranged to engage said played string with differently thick portions thereof when rotated about an axis to vary tension of said played string.

2. The stringed musical instrument of claim 1, wherein said body is surfboard shaped with rounded edges for comfort.

3. The stringed musical instrument of claim 1, wherein said pitch changer is positioned inside a top recess on said top of said body.

4. The stringed musical instrument of claim 1, further including a lever connected to an axle of said eccentric cam.

5. The stringed musical instrument of claim 1, further including a stop connected to an axle of said eccentric cam, wherein said stop is arranged to engage an obstacle when said cam is rotated to a predetermined position.

6. The stringed musical instrument of claim 1, further including tuners on a bottom of said body, wherein adjacent ends of said strings are threaded through said body from a top of said body to said bottom of said body and connected to said tuners.

7. The stringed musical instrument of claim 1, further including tuners connected to said strings, wherein said tuners are comprised of knobs connected to respective gear boxes which are positioned through a wall of a bottom recess on a bottom of said body, and extension rods in said bottom recess connected to rotatable inner ends of said gear boxes, wherein said strings are positioned through said body from said top thereof and bent around a rotatable support rod inside said bottom recess, wherein adjacent ends of said strings are connected orthogonally to respective extension rods.

8. The stringed musical instrument of claim 1, further including tuners connected to said strings, wherein said tuners are arranged in two parallel series on opposite sides of said body, said tuners are comprised of knobs attached to outer ends of respective gear boxes, and extension rods attached to rotatable inner ends of said gear boxes, wherein said extension rods on each side of said body are of graduated lengths to position inner ends of said extension rods in a stepped arrangement, wherein said extension rods attached to shorter strings are shorter, and said extension rods attached to longer strings are longer, said stepped arrangement of said extension rods enabling said extension rods to be orthogonal to said strings while enabling respective extension rods to avoid interfering with adjacent strings.

9. A stringed musical instrument, comprising:

a body;

a bridge on top of said body;

strings tensioned on top of said body and curved around said bridge to a position below an upper surface of said body; and a combined tuner and pitch changer comprised of hinged arms pivoted on an axle, and adjustment screws respectively engaged against said hinged arms, wherein adjacent ends of said strings are attached to said hinged arms below said upper surface of said body, said adjustment screws are rotatable to adjust tension of said strings for tuning and pitch change.

10. The stringed musical instrument of claim 9, further including open slots respectively on said hinged arms to allow said strings to slide in from respective sides of said hinged arms.

* * * * *